US007601085B2

(12) United States Patent
Maziarz

(10) Patent No.: US 7,601,085 B2
(45) Date of Patent: Oct. 13, 2009

(54) SPORTS BALL AND METHOD OF MANUFACTURING

(75) Inventor: Michael W. Maziarz, Wilbraham, MA (US)

(73) Assignee: Russell Brands, LLC, Alexander City, AL (US)

( * ) Notice: Subject to any disclaimer, the term of this patent is extended or adjusted under 35 U.S.C. 154(b) by 264 days.

(21) Appl. No.: 11/266,800

(22) Filed: Nov. 4, 2005

(65) Prior Publication Data

US 2007/0105669 A1 May 10, 2007

(51) Int. Cl.
*A63B 41/08* (2006.01)

(52) U.S. Cl. ..... 473/604; 473/597

(58) Field of Classification Search ..... 473/597–599, 473/603–605, 607; D21/712, 713
See application file for complete search history.

(56) References Cited

U.S. PATENT DOCUMENTS 1,187,029 A 6/1916 Beebout
1,438,226 A * 12/1922 Edwards ..... 473/607
D92,721 S * 7/1934 Jary ..... D21/712
2,194,132 A * 3/1940 Voit et al. ..... 473/605
2,194,674 A * 3/1940 Riddell ..... 473/597
D183,431 S * 8/1958 Senne ..... D21/713
3,405,018 A 10/1968 Way
D235,794 S * 7/1975 Kroener ..... D21/712
RE33,449 E * 11/1990 Martin ..... 473/613
5,165,685 A 11/1992 Hynes
D341,869 S * 11/1993 Louez ..... D21/713
5,310,178 A 5/1994 Walker et al.
D354,102 S * 1/1995 Lehman ..... D21/712
D369,192 S * 4/1996 Imswiler ..... D21/713
D369,193 S * 4/1996 Imswiler ..... D21/713
D382,927 S * 8/1997 McGowen et al. ..... D21/712
5,681,233 A 10/1997 Guenther et al.
D393,030 S * 3/1998 Mills ..... D21/713
5,741,195 A 4/1998 Sullivan et al.
D432,604 S * 10/2000 Scheiner ..... D21/714
D457,208 S * 5/2002 Murphy et al. ..... D21/712
6,520,877 B1 2/2003 Yang
D484,934 S * 1/2004 Chang ..... D21/713

* cited by examiner

*Primary Examiner*—Steven Wong

(57) ABSTRACT

The present development is directed to sports balls or game balls and to methods for producing the same. More particularly, the disclosure is directed to inflatable sports balls or game balls, such as basketballs, having a unique rib or seam configuration.

9 Claims, 4 Drawing Sheets

SPORTS BALL AND METHOD OF MANUFACTURING

BACKGROUND

The present disclosure relates generally to the field of sports balls or game balls. More particularly, the disclosure is directed to inflatable sports balls or game balls, such as basketballs, having improved grip, feel and other characteristics, and the methods for producing such sports balls.

Seams, ribs, or depressed channels along the outer surface of many sports balls, such as a basketball, originated as a consequence of the manufacturing process employed to produce such balls. Traditionally, a series of panels or sections were secured or otherwise affixed onto a carcass or other underlying layer to provide a durable and protective outer cover layer. The interfaces between adjoining panels evolved into seams, ribs, or depressed channels (collectively referred to herein as "seams") as evident on many known sports balls.

Whether intentional or not, the seams on many sports balls also serve as points of gripping the ball. That is, increased contact with a sports ball is often possible along seams extending on the ball's exterior. Although efforts have been made to promote gripping of sports balls, the overwhelming majority of previous efforts have been directed to increasing the frictional characteristics of the outer surfaces of such balls. Alternate approaches have also involved the incorporation of various cushioning layers beneath the cover. Although satisfactory in many respects, a need remains for another approach to promote gripping sports balls having seams.

U.S. Pat. No. 5,165,685 is directed to a game ball that includes a collection of circular seams extending about the exterior of the ball. The stated purpose of the seam configuration is to enable an athlete to grip the seams with up to five fingers to thereby facilitate gripping the ball.

Although the '685 patent notes that the game ball may be a basketball, a significant disadvantage of the balls described in that patent is that the balls do not resemble a basketball, and particularly the present form of basketballs such as used in competitive play. Most conventional basketballs utilize a seam arrangement in which typically, eight seams extend across the ball, between two oppositely located end regions. It is this seam configuration that gives basketballs their unique, and well recognized, appearance.

The fact that basketballs have generally retained the same appearance and seam configuration for approximately 90 years, i.e. see U.S. Pat. No. 1,187,029 in this regard, is an indication of the reluctance of the purchasing public, sports fans, professional and collegiate organizations, and the media to adopt a basketball design that significantly departs from the conventional design. Accordingly, it would be beneficial to provide a sports ball and particularly a basketball that utilized a seam configuration which promoted gripping yet, which retained the overall appearance and impression associated with conventional basketballs.

BRIEF DESCRIPTION OF THE DISCLOSURE

Disclosed herein are new and useful inflatable basketballs or other sports balls and methods of manufacturing same. In one aspect, a sports ball is provided comprising a cover defining a circumference and a seam configuration. The seam configuration includes a collection of non-crossing seams extending across at least a portion of the cover and each seam extending a distance across the cover that is at least 50% of one-half of the circumference. At least one seam of the collection of seams includes a first seam segment exhibiting a curvature about a first center point on a first side of the seam, and a second seam segment exhibiting a curvature about a second center point on a second side of the seam segment, opposite the first side.

In another aspect, a sports ball is provided comprising an inflatable carcass, and a cover disposed on the carcass. The cover defines a seam configuration including (i) a first end region disposed at a first location on the ball, (ii) a second end region disposed at a second location on the ball, opposite from the first location; and (iii) a collection of seams extending between the first end region and the second end region. At least one seam of the collection of seams includes a first seam segment exhibiting a curvature about a first point on a first side of the seam, and a second seam segment exhibiting a curvature about a second point on a second side of the seam segment, opposite the first side.

In yet another aspect, a sports ball is provided comprising a cover which defines a particular seam configuration. That configuration includes (i) a first end region disposed at a first location on the ball, (ii) a second end region disposed at a second location on the ball, opposite from the first location, and (iii) a collection of seams extending between the first end region and the second end region wherein at least one seam of the collection of seams includes a first seam segment exhibiting a curvature about a first point on a first side of the seam and a second seam segment exhibiting a curvature about a second point on a second side of the seam segment, opposite the first side. The collection of seams extend across at least a portion of the cover and each seam extends a distance across the cover that is at least 50% of one-half of the circumference.

In yet a further aspect, a sports ball is provided that comprises a cover which defines a particular seam configuration. The seam configuration includes a collection of seams that include at least one seam which extends through a first inflection point that separates portions of the seam having opposite curvatures. The seam also extends through a second inflection point that separates portions of the seam having opposite curvatures.

There has thus been outlined, rather broadly, some of the more important features of the sports ball disclosed herein in order that the detailed description thereof that follows may be better understood. There are, of course, additional features of the disclosure that will be described hereinafter and which will form the subject matter of the claims appended hereto.

In this respect, before explaining at least one embodiment of the sports ball disclosed herein in detail, it is to be understood that the disclosure is not limited in this application to the details of construction and to the arrangements of the components set forth in the following description or illustrated in the drawings. The disclosed sports ball is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present development. It is important, therefore, that the claims be regarded as including such equivalent constructions insofar as they do not depart from the spirit and scope of the disclosure.

BRIEF DESCRIPTION OF THE DRAWINGS

Other objects and advantages of the development disclosed herein will be evident to one of ordinary skill in the art from the following description and figures, in which.

DETAILED DESCRIPTION

The preferred embodiment sports balls utilize a unique seam configuration that increases and/or promotes gripping of a sports ball, while retaining an overall appearance suggestive of a conventional basketball. Gripping is enhanced by the seam configuration due, at least in part, to a particular orientation and arrangement of seams along the outer surface of the sports balls.

The term "seam" as used herein refers to a line, interface, marking, or channel extending along the surface of the sports balls described herein which is characterized by a depression or surface region that is disposed below the non-seam surface areas of the ball. The term "seam" as used herein does not include markings or other patterns or colorations on the ball that are not at a depressed elevation relative to the other surface areas of the ball.

More specifically, the seams and their arrangement accommodate the shape of a human hand. The configuration of seams on a conventional basketball for example is straight and is such that a typical player or user of the ball can only place 1 or 2 fingers of a hand, simultaneously on or within a seam along the ball's exterior.

Figure 1:
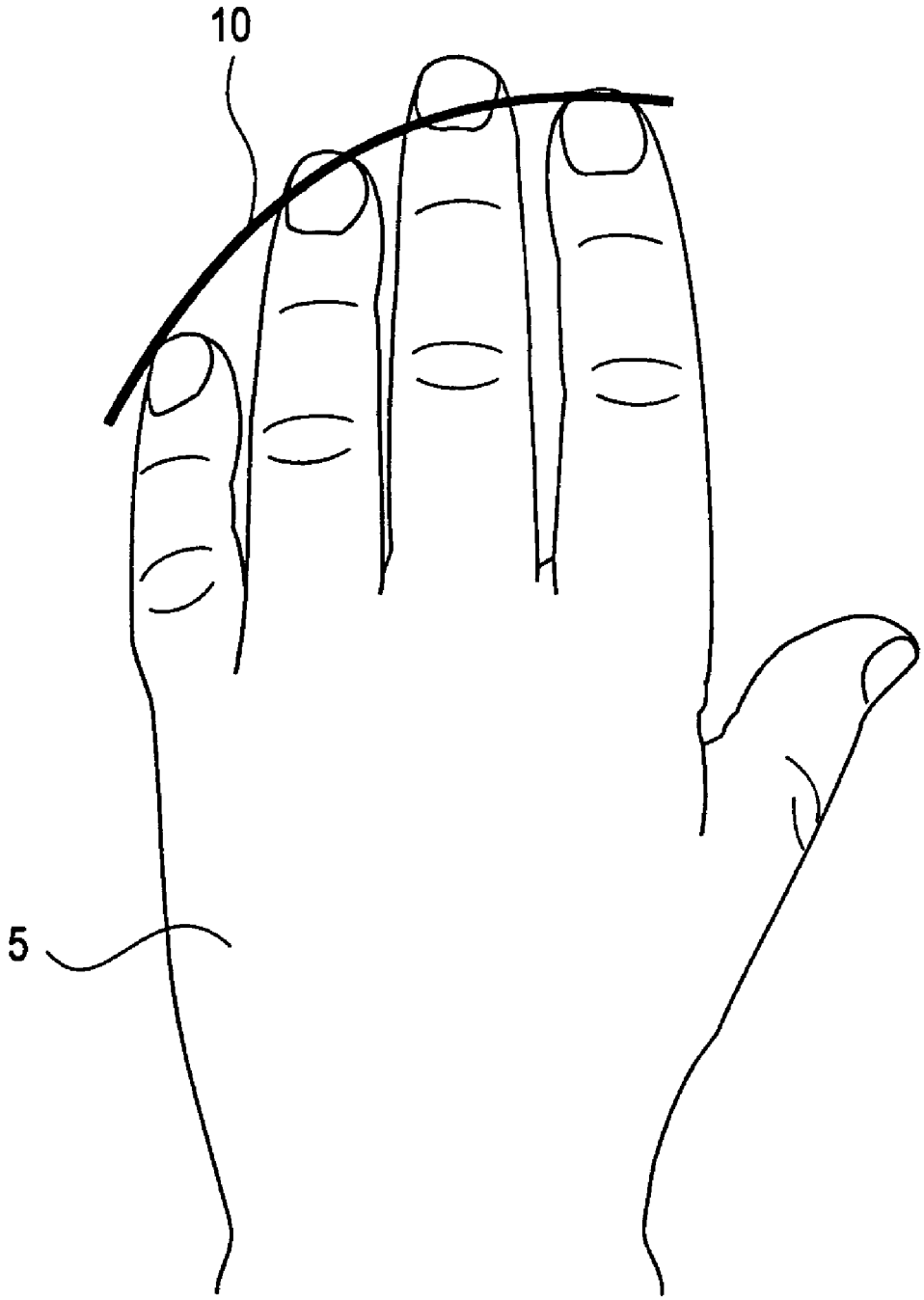
FIG. 1 is a schematic illustration depicting placement of a hand and fingers upon a preferred embodiment sports ball and the relation of the fingers to a seam segment defined on the ball.
Figure 2:
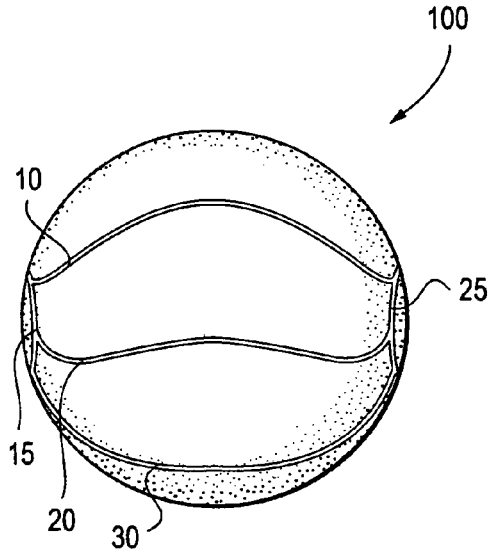
FIG. 2 is a front view of a preferred embodiment sports ball.
Figure 3:
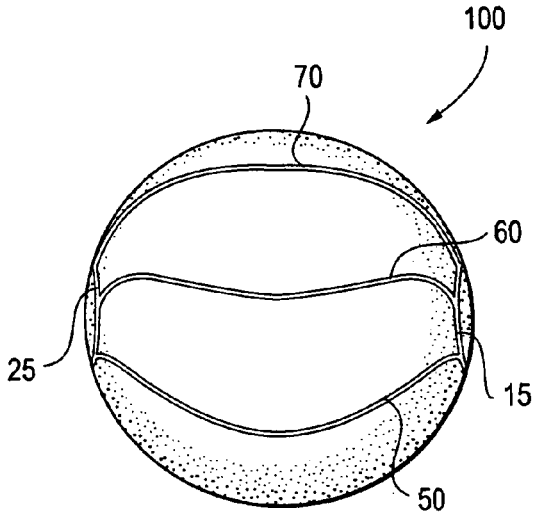
FIG. 3 is a back view of the preferred embodiment sports ball depicted in FIG. 2.
Figure 4:
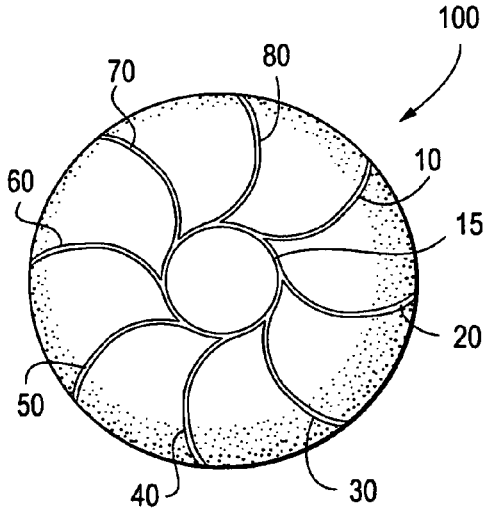
FIG. 4 is a left side view of the preferred embodiment sports ball depicted in FIG. 2.
Figure 5:
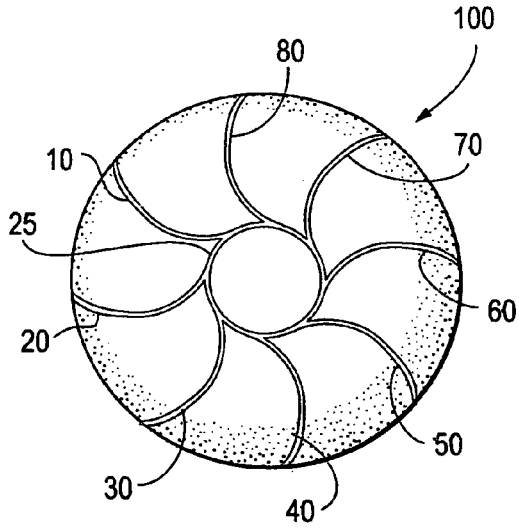
FIG. 5 is a right side view of the preferred embodiment sports ball depicted in FIG. 2.

In contrast, the preferred embodiment sports balls described herein utilize a seam configuration that comprises seams that extend in multiple directions over the ball's exterior, and preferably, in an arcuate fashion. Such a configuration creates a high probability that a player can readily find a seam during play, and place at least two, preferably three, and more preferably four fingers of a hand, such as hand 5 shown in FIG. 1, simultaneously, on or within a seam 10 along the ball's exterior.

The preferred embodiment sports balls utilize a unique seam configuration. Generally, the preferred seam configurations extend across the outer surface of the ball. The seams extend between two oppositely located end regions also defined on the ball. The seams extend across at least one half and preferably at least 70%, more preferably at least 80%, and most preferably at least 90% the distance between the centers of the end regions, as measured along a line extending on the surface of the ball from one pole to another. Such a line has a length equal to one-half of the circumference of the ball. And so, the seams of the preferred seam configurations extend at least one-half, preferably at least 70%, more preferably at least 80%, and most preferably 90% of one-half of the ball's circumference.

Another aspect that can be exhibited by the preferred seam configurations described herein is that preferably, the seams do not cross or intersect one another. Utilizing such a non-crossing pattern of seams assists in retaining the overall appearance associated with conventional basketballs.

A further aspect that can be exhibited by the preferred seam configurations is that one or more of the seams are characterized as having two or more inflection points. Each inflection point separates segments of the seam, or coincides with points at which segments change in not only direction, but also the type of curvature, such as for example, a concave curvature or a convex curvature.

Yet another aspect that can be exhibited by the preferred seam configurations described herein is that preferably, one or more of the seams include (i) an arcuate seam segment that exhibits a curvature about a center point located on one side of the seam, and (ii) another arcuate seam segment that exhibits a curvature about a center point located on an opposite side of the seam. More preferably, the seam configuration includes one or more seams that include (i) a first arcuate seam segment that exhibits a curvature about a center point on one side of the seam, (ii) a second arcuate seam segment that exhibits a curvature about a center point on an opposite side of the seam, and (iii) a third arcuate seam segment that exhibits a curvature about a center point on the same side of the seam as the first arcuate seam segment. Preferably, the second arcuate seam segment is disposed between the first and third arcuate seam segments. The use of seam configurations exhibiting these characteristics enables a player to readily establish contact between several fingers and the seam, such as during play.

The preferred seam configuration can include seams that also comprise fourth, fifth, sixth or more additional arcuate seam segments. Moreover, it is contemplated that seam segments that are not arcuate or curved can be utilized. In addition, the preferred seam configuration comprises multiple seams as described herein that extend between two oppositely located end regions. Preferably, the seam configuration comprises from about 2 to about 20 seams, more preferably comprises 6 to 12 seams, and most preferably comprises 8 seams that exhibit one or more of the characteristics described herein.

As noted, the preferred seam configuration includes two oppositely located end regions defined on the outer surface of the ball or visible along the exterior surface of the ball. The end regions are defined by channels or depressions similar to the seams. The end regions can each be in a variety of different sizes, shapes, orientations, or arrangements. Preferably, the end regions are of the same shape and size, and most preferably each circular in shape. However, the preferred seam configuration includes end regions that are triangular, square, five sided, six sided, seven sided, eight sided and so on. That is, the end regions can be polygonal and have a number of sides such as from 3 to about 40. If polygonal, it is preferred that an end region have the same number of sides as the number of seams.

A preferred embodiment of a seam configuration as utilized on a basketball 100 is illustrated in FIGS. 2-6. Generally, the preferred seam configurations extend across the outer surface or at least are visible along the outer surface of the ball 100. The seams 10, 20, 30, 40, 50, 60, 70, and 80 extend between two oppositely located end regions 15 and 25 also defined on the ball 100. The seams extend across at least one half the distance and preferably at least 70%, more preferably at least 80%, and most preferably at least 90% the distance between the centers of end regions 15 and 25, as measured along a straight line extending on the surface of the ball from one pole to another. Such a line has a length equal to one-half of the circumference of the ball.

The seams 10, 20, 30, 40, 50, 60, 70, and 80 do not cross or intersect one another. That is, each of the seams of the group extend in a non-crossing fashion with respect to the other seams. For example seam 60 does not cross, contact, or merge with any of seams 10, 20, 30, 40, 50, 70, or 80. Utilizing such a non-crossing pattern of seams assists in retaining the overall appearance associated with known basketballs. As shown in the referenced figures however, it is preferred that one or more seams terminate at the end regions of the ball.

Another aspect of the preferred embodiment seam configuration relates to the manner in which one or more of the seams extend across the ball and preferably, between end regions. Specifically, one or more, and preferably all of the seams of the seam configuration include two inflection points that separate regions or seam segments having different types of curvature, i.e. concave or convex. Alternately, the inflection points coincide with points on the seam at which the seam not only changes direction, but changes in its type of curvature, i.e. concave or convex. For example, referring to FIG. 6, the ball 100 is depicted with a seam configuration including seams 50, 60, and 70. Seam 60, for example, includes a first inflection point X and a second inflection point Y. The first inflection point X separates regions in which the seam changes in its type of curvature, i.e. concave or convex. Point X separates a first seam segment 62 from a second seam segment 64. The first seam segment 62 exhibits a convex curvature depending on the ball's orientation and the second seam segment 64 exhibits a curvature opposite from that of the first seam segment, i.e. concave. Similarly, the second inflection point Y separates regions in which the seam changes in its type of curvature, i.e. concave or convex. Point Y separates the second seam segment 64 from a third seam segment 66. The second seam segment 64 exhibits a concave curvature depending on the ball's orientation and the third seam segment 66 exhibits a curvature opposite from that of the second seam segment, i.e. convex.

As noted, one or both of the inflection points can coincide with points at which the seam changes in its type of curvature. In this embodiment, the portion of the first seam segment 62 immediately to the left of point X in FIG. 6, would exhibit a first curvature type such as convex, and the portion of the second seam segment 64 immediately to the right of point X would exhibit a second opposite curvature, such as concave.

The points of inflection, as described herein are defined along one or more seams and between end regions. That is, the preferred embodiment seam configurations do not include seam patterns that have seams characterized by having inflection points within one or both end regions.

In another aspect, the preferred embodiment seam configuration can exhibit the following characteristics. One or more of the seams such as seam 60 shown in FIG. 6 include (i) an arcuate seam segment 62 that exhibits a curvature about a center point B located on one side of the seam 60, and (ii) another arcuate seam segment 64 that exhibits a curvature about a center point A located on an opposite side of the seam 60. More preferably, the seam configuration includes one or more seams such as seam 60 that include (i) a first arcuate seam segment 62 that exhibits a curvature about a center point B on one side of the seam 60, (ii) a second arcuate seam segment 64 that exhibits a curvature about a center point A on an opposite side of the seam 60, and (iii) a third arcuate seam segment 66 that exhibits a curvature about a center point C on the same side of the seam 60 as the first arcuate seam segment 62. Preferably, the second arcuate seam segment 64 is disposed between the first and third arcuate seam segments 62 and 66, respectively.

As noted, the preferred seam configuration includes two oppositely located end regions 15 and 25 defined on the outer surface of the ball 100 or visible along the exterior surface of the ball. The end regions 15 and 25 can each be in a variety of different sizes, shapes, orientations, or arrangements. Preferably, the end regions 15 and 25 are of the same shape and size, and most preferably each circular in shape.

Figure 6:
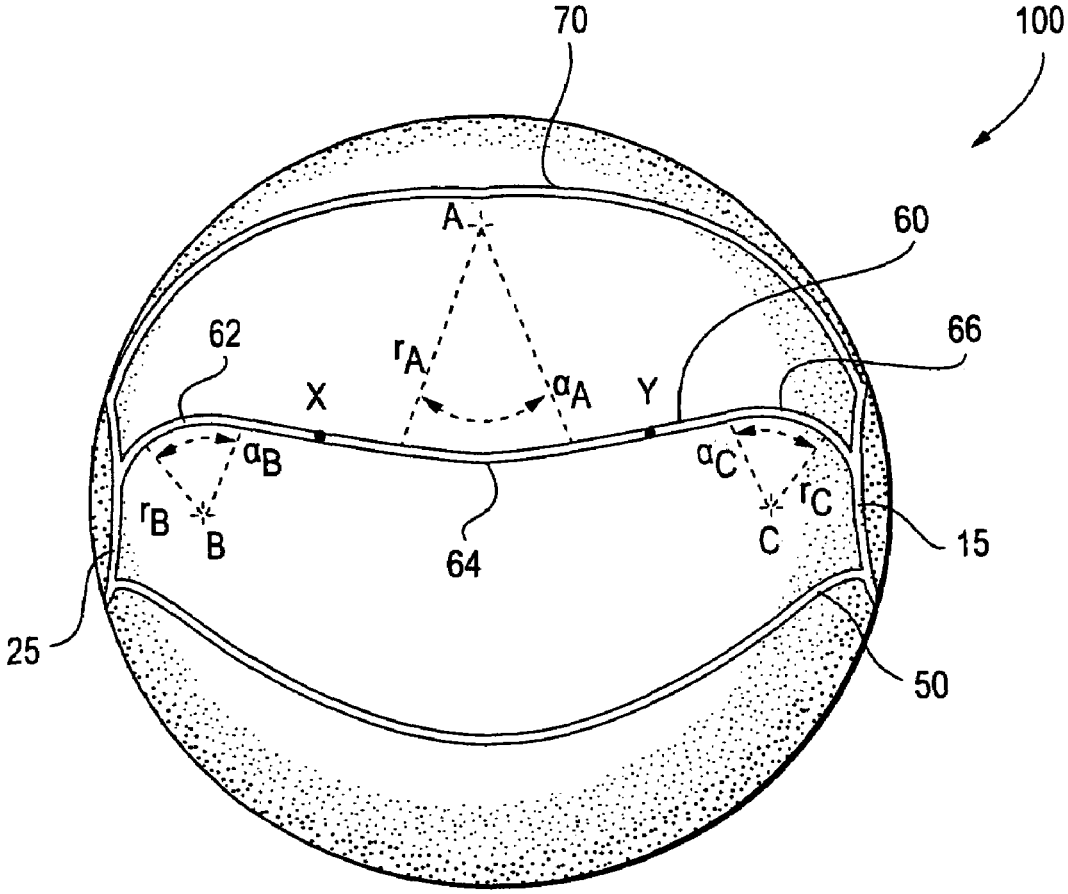
FIG. 6 is a detailed view of the ball depicted in FIGS. 2-5, illustrating a preferred embodiment seam configuration and preferred characteristics thereof.

Alternate preferred aspects for each of the seam segments, such as seam segments 62, 62, and 66 of seam 60 depicted in FIG. 6 are as follows. The seam segment 62 can extend about point B, which preferably also serves as a center point for curvature exhibited by seam segment 62 when the segment is in a preferred arcuate form. For seam segment 62 being arcuate, the point B is spaced from the seam segment 62 a distance $r_B$. Most preferably, the seam segment 62 extends about point B through an angle $\alpha_B$. The seam segment 64 can extend about point A, which preferably serves as a center point for curvature exhibited by a preferred form of seam segment 64, i.e. arcuate. For seam segment 64 being arcuate, the point A is spaced from the seam segment 64 a distance $r_A$. Most preferably, the seam segment 64 extends about point A through an angle $\alpha_A$. The seam segment 66 can extend about point C, which preferably serves as a center point for curvature exhibited by a preferred form of seam segment 66, i.e. arcuate. For seam segment 66 being arcuate, the point C is spaced from the seam segment 66 a distance $r_C$. Most preferably, the seam segment 66 extends about point C through an angle $\alpha_C$.

Referring further to FIG. 6, other preferred aspects of the seam configuration are as follows. The distance $r_A$ is greater than either of $r_B$ and $r_C$. The distances $r_B$ and $r_C$ are equal or substantially so. The angles $\alpha_B$ and $\alpha_C$ are equal or substantially so.

The preferred embodiment sports balls can exhibit one or more of any of the previously described features. That is, the balls need not exhibit all of the noted features. And, the preferred embodiment seam configurations need not exhibit all of the noted features.

Figure 7:
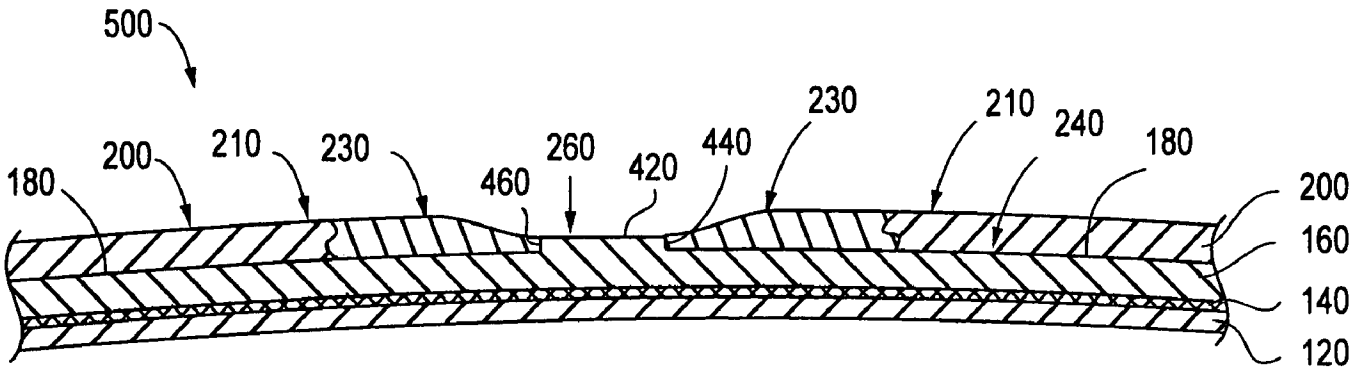
FIG. 7 is a partial cross-sectional view of a layer construction for forming a preferred embodiment sports ball.
Figure 8:
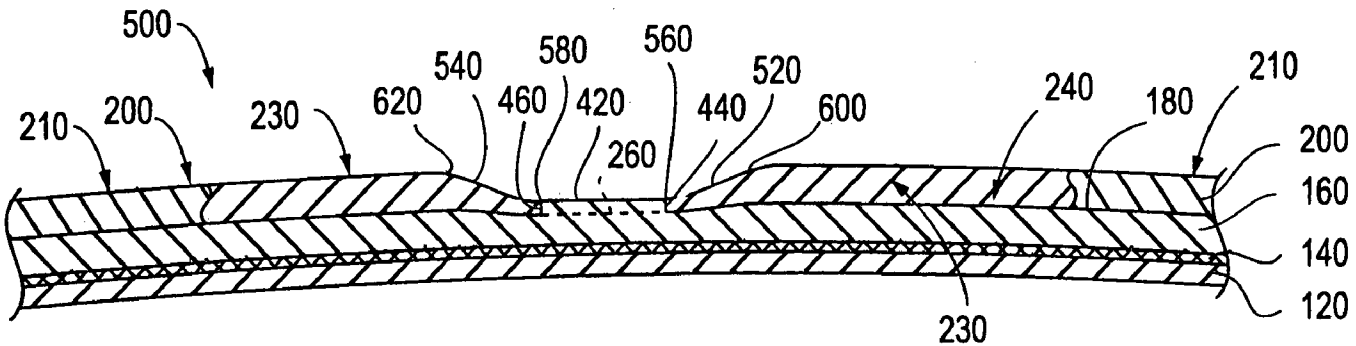
FIG. 8 is a partial cross-sectional view of another layer construction for forming a preferred embodiment sports ball.

A sports ball, such as a basketball, constructed in accordance with the principles of one embodiment of the present development, generally indicated by the numeral 500, can readily be understood with reference to FIGS. 7 and 8, wherein the numerals represent like parts. Such a basketball is comprised generally of four major components: an interior air bladder 120, a layer 140 of reinforcement strands wound over the bladder, a carcass 160 formed over the wound layer and defining panel areas 180 and seams 260, with exterior or "skin" panels 200 secured in the panel areas 180 of the carcass 160.

More specifically, the bladder 120 is formed spherically and is adapted to be inflated with air. The bladder 120, when properly inflated, provides the primary resilience for the finished basketball 500. Such air bladders are usually formed of butyl rubber or butyl and natural rubber compounds and are fitted with a valve stem (not shown) for introducing air into the ball to inflate and pressurize the structure. The preferred material for the bladder is principally synthetic butyl rubber, but may include natural rubber, such as about 15% natural rubber.

Outwardly disposed of the interior air bladder is a layer 140 comprising monofilament polymeric strands, preferably of nylon or polyester. The strands are optionally coated with an adhesive (not shown), preferably a rubber cement, to ensure retention of the strands on the bladder. The winding layer 140 adds dimensional stability to the bladder 120 and the ball 500, restrains outward expansion when inflated, and also reduces outward pressure on the carcass 160.

The next exterior-most layer of the basketball 500 is an elastomer carcass 160. The carcass is preferably fabricated from a polymer composition molded over the wound bladder. Rubber (natural and/or synthetic) is preferred for improved rebound and durability. The rubber is placed in a carcass mold and cured under conventional temperatures, pressures, etc. The resulting molded carcass 160 has a substantially spherical outer surface 240 defining a carcass circumference. A plurality of curvilinearly extending seams 260 are projected above the carcass circumference.

The exterior face 420 of the extending seam 260 is above the substantially spherical outer surface. The outwardly extending seam 260 also has lateral, generally vertical sides 440 and 460. It should be noted that while the carcass 160 and seams 260 are described separately for clarity, in practice the carcass 160 will be formed as an integral portion including panel areas 180 and seams 260 around the wound layer 140. The carcass surface 240 between the seams 260 defines the plurality of panel areas 180. While not shown, a seam 260 having non-linear vertical rib sides, non-linear rib faces or radiused shoulders is also fully encompassed by this development.

The carcass 160 has a thickness in the range of about 0.5 mm to about 1.5 mm and a preferred range of about 0.8 mm to about 1.2 mm over the majority of the panel areas 180. The seam 260 has a thickness in the range of about 0.75 mm to about 1.50 mm. The carcass 160 may also comprise an integral cellular portion (not shown) adjacent the winding layer 140.

The preferred material for the carcass 160 is a rubber compound (i.e., polyisoprene, polybutadiene, etc.). The carcass 160 is preferably formed of two hemispheres separated at an equator line, which are preferably molded over the winding layer 140. The molding of the carcass hemispheres onto the winding layer forms a unitary, relatively seamless carcass 160 comprising seams 260, panel areas 180 and also causes the carcass material to flow into and around the strands of the winding layer 140 for a secure mechanical bond.

The exterior-most cover of the basketball 500 is formed of discrete exterior panels 200 made from two or more materials having different characteristics, such as an inner panel portion 210 and outer panel portion 230. The parts are joined together to form the desired designed configuration of the overall exterior panel 200. The panels 200 are then shaped, such as by being cut, to fit within the panel areas 180 between the seams 260. Edge portions 520, 540 of the panels 200 can also be beveled or skived from a shoulder 600, 620 to form a panel edge 560, 580 respectively. The panel edges 560, 580, when laminated, will be adjacent a seam side 440, 460 and generally flush with the seam exterior face 420. A bonding agent, such as an adhesive, preferably a contact cement such as styrene butadiene, holds the panels 200 in place to the panel areas 180 of the carcass 160. Opposing panel shoulders 600, 620, panel edge portions 520, 540 and seam 260 define a panel seam or channel area.

Typically, the overall ball 500 comprises a total of eight (8) exterior cover panels 200 of the noted configurations separated by the panel seam or channel areas. However, other arrangements are also contemplated herein. Optionally, the outer surfaces of the panels are also textured to produce a pebbled surface to produce a "leathered" appearance.

The panels 200 can be fabricated by joining together materials of different characteristics and/or compositions, in various sizes, shapes and configurations. For example, a die-cut machine can be used to form generally "segmented shaped" inner panel portions 210, and generally "linear shaped" outer panel portions 230 from the selected materials. Each said inner panel portion 210 is connected at its edges to a said outer panel portion 230 at one of its edges. Additionally, each said outer panel portion 230 is connected at its opposite edge to the edge of a seam 260.

For example, the panels can be fabricated by utilizing inner and outer panel portions 210 and 230 comprised of various combinations of materials of different hardness/softness, tackiness, resilience, compression, moisture resistance, etc. characteristics which have been shaped and assembled to produce a desired design. An adhesive means, such as contact cement or glue can be applied to the backside of the materials, i.e., the inner panel portion 210 and the outer panel portion 230, and to the seams 260. Said die-cut materials (inner and outer panel portions) can be applied to the seams 260 using a hand-massaging technique or other methods to carefully bring the edges of said inner panel portions to meet the edges of said outer panel portions, and said opposite edges of outer panel portions to meet the ribs. This process can be utilized to construct a high quality basketball having outer panel portions with variable areas of hardness/softness, compression, moisture resistance, etc., thereby providing improvements in ball grip and handling characteristics among others.

It is important to note that the hand-massaging or other techniques used to join the inner and outer panel portions to the ribs ultimately forms the outside cover of the ball, giving the ball its generally round, but distinct appearance. Additionally, the different panel portions produce an outside cover exhibiting areas of non-uniform, variable, or different characteristics, such as tackiness, stiffness, etc. This results in a ball having, for example, not only improved grip and playability characteristics in certain areas, but also, in some instances, enhanced resilience, wear, durability, etc.

An example of an alternative possible construction of the ball includes rubber seams 260 (natural or synthetic) extended into outer rubber panel portions 230 which are then connected to a PVC inner panel portion 210 to form the ball. Such a ball has enhanced feel or grip in the channel areas allowing the player to apply backspin to the ball when desired.

Additional possible, but non-limiting, combinations of materials which can be used on the inner and outer panel portions of the ball are set forth below:

| Outer Panel Portion | Inner Panel Portion |
|---|---|
| Rubber | PVC |
| Rubber | PU |
| Rubber | Synthetic Composite |
| Rubber | Microfiber Composite |
| PVC | Rubber |
| PVC | PU |
| PVC | Synthetic Composite |
| PVC | Microfiber Composite |
| PU | Rubber |
| PU | PVC |
| PU | Synthetic Composite |
| PU | Microfiber Composite |
| Synthetic Composite | Rubber |
| Synthetic Composite | PU |

-continued

| Outer Panel Portion | Inner Panel Portion |
|---|---|
| Synthetic Composite | PVC |
| Synthetic Composite | Microfiber Composite |
| Microfiber Composite | Rubber |
| Microfiber Composite | PVC |
| Microfiber Composite | PU |
| Microfiber Composite | Synthetic Composite |

It is important to note that any combination, variation or substitution of the above-referenced materials can be used to form the inner and outer panel portions 210 and 230. The outer panel portions 230 will ultimately be connected to the seams 260, and also to said inner panel portions to form the cover of the ball. It is also important to note that alternative panel constructions are available and that the embodiments of the development described above are not limited to just the use of inner and outer panel portions. Intermediate and alternative panel portions, varying in characteristics, etc. also fall within the contemplated scope of this development. Moreover, similar materials varying in properties such as hardness/softness, compressibility, resilience, etc. can also be utilized. Such combinations will also produce an outer panel having multiple areas of variable characteristics.

It is further noted that during the manufacturing process of an additional embodiment, the die-cut shapes (i.e. the outer panel portions, inner panel portions, etc.) are about 1.5 mm to about 2.5 mm thick at the center. The outer panel portions are thinner than that near the edges thereof for joining to the seams. This reduced thickness provides a recessed appearance in the seam areas of the ball, and to provide further improved grip and playability of the ball. A skiving or tapering process is used to achieve such reduced thickness on said edges of said outer panel portions.

Once the seams are connected to the outer panel portions and/or the outer panel portions are connected to the inner panel portions to form the cover of the ball, the ball may be further optionally coated or treated (such as by decorating through the application of paint, decals, and other graphics or decorations) to produce an aesthetically pleasing look to the ball and/or to provide strength and durability.

Another valuable aspect of at least one embodiment of the present disclosure is to provide pebbling texture on the surface of each inner panel portion 210 and outer panel portion 230 allowing for improved grip and playability of the ball. The pebbling, such as molded-in pebble texture, simulates the texture of pebble grain leather and also provides for improved grip and handling of the ball.

For example, if the rubber seam is extended to a rubber outer panel portion and a PVC inner panel portion, the outer rubber panel portion can be pebbled. The inner PVC panel portion could also be pebbled; however, the edges of the inner PVC panel portion would be skived, and some of the pebbles on the PVC would have been thinned during the skiving process. Therefore, the development also provides pebbling of greater thickness on the rubber (or other material) outer panel portion, in comparison to the pebbling on the PVC (or other material) inner panel portion.

It should also be noted that certain advantages exist when producing a ball using a combination of materials and/or materials having different properties in the panel portions, as suggested by the present disclosure. Such advantages would be, for example, to use PU on some of the panel portions of the ball to provide more grip, and to use PVC on other panel portions to reduce manufacturing expenses.

It should also be understood that it is possible to change the appearance of the ball by utilizing materials of different colors. For example, the inner and outer panels can be produced from different colored and textured materials. Moreover, the panels can be configured, molded, or engraved to include indicia, such as manufacturers' name, trademarks, molded numbers, inflation instructions, simulated lacing or stitching and graphics, on the surface panel of the ball.

It should also be understood that the design of the present development is most suitable, at the present time, for a basketball. However, it should further be noted that the above-described process and developments can also be used on various types of sports balls, including for example footballs and soccer balls.

An alternative embodiment of the development disclosed herein is as follows. In such embodiment, the seam 260 is extended into the normal panel area 180. This allows for the use of similar materials to form the seams and channel areas. This also allows for the use of molded-in pebbling in the channel areas when the carcass is formed.

The balls of the present disclosure may be produced largely in a conventional manner. Accordingly, the air bladder 120 of the ball would be inflated to an appropriate size and preferably cooled to cause the material of the bladder to become somewhat rigid. In this rigid condition, the air bladder 120 is wound with adhesive coated polymer threads to produce the winding layer 140. The air bladder 120 with the overlying layer of windings 140 is then placed in a mold in which the carcass hemispheres are arrayed. The mold is closed and sealed and optionally the air bladder is inflated to help the bladder make full contact with the carcass materials within the mold, and heat and pressure are applied to cause the rubber of the carcass to cure and vulcanize and become securely attached to the air bladder 120 and winding layer 140. The molding process further forms the structure of the carcass 160, including seams 260 and panel areas 180.

Individual panels 200 are formed to fit over the surface of the carcass within the panel areas 180 defined by the formed seams 260. The edge portion 520, 540 of each panel is skived or tapered. When a skived panel edge 580 is correctly positioned abutting a seam 260, the panel edge will be adjacent a rib side and substantially flush with the outwardly projecting rib face 420.

In the case of a ball with a cellular carcass portion or layer, the cells are typically produced by adding a blowing agent to the raw material. Different concentrations of blowing agent will change the density of the molded cellular layer. Such blowing agents are exemplified by Celogen TSH available, from Uniroyal Chemical, Middlebury, Conn. USA. The cellular layer is typically formed around the substructure formed by the air bladder 120 and the winding layer 140 in a molding process, wherein the bladder/winding substructure is placed in a mold and the cellular layer material in a non-expanded state is molded around the substructure. The heat of the molding operation causes the blowing agent to expand. The end result of the molding operation is a unitary structure with a cured, cellular layer of a desired density molded over the winding layer. The thickness of the cellular layer is governed by the space between the bladder/winding substructure outer diameter and the mold inner diameter. The structure thus formed is placed in a second mold and the carcass hemispheres are molded over the cellular layer.

Subsequently, the completed ball is taken from the mold and flash from the molding process is trimmed from the ball. The ball is then in condition for the application of decals, paint or other decorative or informative markings. The balls described above have preferably the same weight, circumference, and diameter of a "regulation" (size 7) basketball. However, balls of other sizes (i.e., intermediate (size 6), youth (size 5), etc) and weight are also contemplated by this development. The balls may also be utilized for indoor and outdoor play.

Representative manufacturing techniques and other details for forming basketballs and other sports balls are described in U.S. Pat. Nos. 5,681,233; 6,520,877; 3,405,018; 5,310,178; and 5,741,195.

As will be apparent to persons skilled in the art, various modifications and adaptations of the structure described above will become readily apparent without departure of the spirit and scope of the development disclosed herein. The above description merely provides a disclosure of particular embodiments of the development and is not intended for the purposes of limiting the same thereto. Rather, it is recognized that one skilled in the art could conceive alternative embodiments that fall within the scope of the development.

The invention claimed is:

1. An inflatable sports ball comprising:

a cover having a total of ten seams, wherein:

a first seam defines a first end region and a second seam defines a second end region, the first and second end regions being located on opposite ends of the ball;

the remaining eight seams do not intersect each other;

the two ends of each of the remaining eight seams terminates at the first seam and the second seam; and each of the remaining eight seams has a first inflection point and a second inflection point, the first inflection point separating a first seam segment and a second seam segment, and the second inflection point separating the second seam segment and a third seam segment;

wherein the first seam segment and the second seam segment have opposite curvatures; and the second seam segment and third seam segment have opposite curvatures.

2. The sports ball of claim 1, wherein each of the eight remaining seams extends a distance across the cover that is at least 70% of one-half of the circumference.

3. The sports ball of claim 1, wherein each of the eight remaining seams extends a distance across the cover that is at least 80% of one-half of the circumference.

4. The sports ball of claim 1, wherein each of the eight remaining seams extends a distance across the cover that is at least 90% of one-half of the circumference.

5. The sports ball of claim 1, wherein the first end region and the second end region are the same size.

6. The sports ball of claim 1, wherein the first end region and the second end region are the same shape.

7. The sports ball of claim 1, wherein the first and second end regions are circular.

8. The sports ball of claim 1, wherein the first and second end regions are polygonal.

9. The sports ball of claim 8 wherein each of the first and second end regions includes from 3 to 40 sides.

* * * * *